US008826948B2

(12) United States Patent
Macquet et al.

(10) Patent No.: US 8,826,948 B2
(45) Date of Patent: Sep. 9, 2014

(54) MACHINE FOR FILLING VESSELS WITH TWO PRODUCTS

(75) Inventors: Philippe Macquet, Octeville sur Mer (FR); Thierry Loaec, Octeville sur Mer (FR)

(73) Assignee: Sidel Participations, Octeville sur Mer (FR)

( * ) Notice: Subject to any disclaimer, the term of this patent is extended or adjusted under 35 U.S.C. 154(b) by 900 days.

(21) Appl. No.: 12/809,003

(22) PCT Filed: Dec. 16, 2008

(86) PCT No.: PCT/EP2008/010726

§ 371 (c)(1),
(2), (4) Date: Jun. 17, 2010

(87) PCT Pub. No.: WO2009/077165

PCT Pub. Date: Jun. 25, 2009

(65) Prior Publication Data

US 2010/0300580 A1 Dec. 2, 2010

(30) Foreign Application Priority Data

Dec. 17, 2007 (FR) ..... 07 59889

(51) Int. Cl.

| | |
|---|---|
| ***B65B 1/04*** | (2006.01) |
| ***B67C 3/20*** | (2006.01) |
| ***B67C 3/02*** | (2006.01) |
| ***B65B 3/32*** | (2006.01) |

(52) U.S. Cl.

CPC ..... *B65B 3/326* (2013.01); *B67C 3/208* (2013.01); *B67C 3/023* (2013.01); *B67C 3/206* (2013.01)

USPC ..... 141/104; 141/234; 141/248; 141/285; 141/302

(58) Field of Classification Search

USPC ..... 141/9, 83, 99, 100, 104–107, 234, 248, 141/285, 301, 302; 222/129, 145.1, 145.7, 222/145.8

See application file for complete search history.

(56) References Cited

U.S. PATENT DOCUMENTS

| | | | |
|---|---|---|---|
| 2,638,259 | A | 5/1953 | Garrett |
| 5,107,907 | A | 4/1992 | Marchadour |

(Continued)

FOREIGN PATENT DOCUMENTS

| | | | |
|---|---|---|---|
| EP | 0 999 175 | A1 | 5/2000 |

OTHER PUBLICATIONS

Written Opinion of the International Searching Authority for International Application No. PCT/EP2008/010726 dated Jul. 27, 2010.

*Primary Examiner* — Timothy L Maust

(74) *Attorney, Agent, or Firm* — Patterson Thuente Pedersen, P.A.

(57) ABSTRACT

A filling machine with at least one volumetric metering system which comprises a cylinder provided with a piston driven by electric or pneumatic actuation device connected to a parametrisable control unit of the machine, and provided within the lower portion with a first suction opening connected by a first suction duct to a first storage tank, with a second inlet opening connected by a second suction duct to a second tank, and with a discharge opening connected by a discharge duct to a filling nozzle. Valve systems formed of clack valves are mounted in the suction ducts and on the filling nozzle, each valve system being driven individually for opening and for closing by individual electric and/or pneumatic actuation device connected to the control unit of the machine.

6 Claims, 2 Drawing Sheets

(56) References Cited

U.S. PATENT DOCUMENTS

| | | | | |
|---|---|---|---|---|
| 5,224,526 | A * | 7/1993 | Mette et al. | 141/285 |
| 5,713,403 | A * | 2/1998 | Clusserath et al. | 141/104 |
| 5,924,462 | A * | 7/1999 | McKaughan | 141/145 |
| 6,065,510 | A * | 5/2000 | Andersson et al. | 141/105 |
| 6,311,740 | B1 * | 11/2001 | Sperry et al. | 141/129 |
| 6,336,572 | B1 * | 1/2002 | Fujikawa et al. | 222/380 |
| 6,463,964 | B2 * | 10/2002 | Clusserath | 141/40 |
| 7,299,606 | B2 * | 11/2007 | Bonatti et al. | 53/473 |
| 7,409,971 | B2 * | 8/2008 | Bonatti et al. | 141/9 |
| 2004/0011423 | A1 * | 1/2004 | Tammi | 141/100 |
| 2004/0108334 | A1 * | 6/2004 | Strecker | 222/145.1 |

* cited by examiner

MACHINE FOR FILLING VESSELS WITH TWO PRODUCTS

PRIORITY CLAIM

The present application is a National Phase entry of PCT Application No. PCT/EP2008/010726, filed Dec. 16, 2008, which claims priority from French Application No. 0759889, filed Dec. 17, 2007, the disclosures of which are hereby incorporated by reference herein in their entirety.

TECHNICAL FIELD

This invention relates to a machine for the filling of hollow vessels, such as bottles or pots, with at least two filling products, in particular with two food products, in particular liquids.

BACKGROUND ART

It is known, in particular by U.S. Pat. No. 5,107,907 discloses a machine for the filling of vessels with a mixture of two food products, the machine, of the rotating type, comprising two tanks arranged one above the other for the storage of two filling products, a plurality of filling stations each comprising a filling nozzle and a volumetric metering system, conventionally called a volumetric metering device. The metering device comprises a cylinder, defining a metering chamber, provided with a suction and discharge piston, and provided in the lower portion with a first suction opening connected by a first suction duct to a first storage tank, with a second suction opening connected by a second duct to the second tank, and with a discharge opening connected by a discharge duct to a filling nozzle. Valve systems are provided to selectively put the metering chamber in fluid communication with the first tank, the second tank or the filling nozzle.

These valve systems include a hollow tube mounted rotatingly in the cylinder and provided with openings facing the suction and discharge openings according to the position in rotation of said tube and a second piston, mounted in the filling nozzle, which can be displaced from a high position to a low position in order to respectively open and close the dispensing opening of the filling nozzle. The control in rotation of the rotating tube, as well as the control of the piston of the filling nozzle and of the suction and discharge piston, are carried out by means of different mechanical cam systems.

These valve systems, with a rotating tube arranged inside the metering cylinder itself, make it possible to substantially discharge all of the mixture carried out subsequent to two suction phases, guaranteeing as such a good precision in the meterings. This rotating tube is however delicate to install. The different mechanical cam-actuated systems, as well as the suction ducts are heavy and long to install, and substantially increase the amount of space taken up by the machine. Any modification of the desired mixture further requires a full replacement of the cam systems. Furthermore, the filling stations of the machine cannot be used differently, the mixtures of products being all identical from one filling station to another.

A filling machine that overcame at least one of the aforementioned disadvantages, that is simple in terms of design, easily adaptable to the desired mixture of products, while still guaranteeing a precise metering of the different products in the mixture, would present decided advantages.

SUMMARY OF THE INVENTION

To this effect, the present invention provides a machine for filling vessels, more preferably rotative, comprising at least two tanks for the storage of two filling products, and at least one filling station comprising a filling nozzle and a volumetric metering system, the volumetric metering system including

- a cylinder, defining a metering chamber, provided with a suction and discharge piston driven by first actuation device, and provided in the lower portion with a first suction opening connected by a first suction duct to a first storage tank, with a second inlet opening connected by a second suction duct to the second tank, and with a discharge opening connected by a discharge duct to the filling nozzle,
- valve systems able to be driven by second actuation device in order to selectively put the metering chamber in fluid communication with the first tank, the second tank and/or the filling nozzle, the valve systems including a first valve system and a second valve system mounted respectively in the first suction duct and the second suction duct, and a third valve system arranged on the filling nozzle, each valve system being driven individually for opening and for closing by second individual pneumatic and/or electric actuation device connected to a parametrisable control unit of the machine, the suction and discharge piston being driven by electric or pneumatic actuation device connected to the control unit.

According to an embodiment of the invention, the valve systems are mounted upstream of the suction openings and downstream of the discharge opening, and can as such be driven individually by separate electric and/or pneumatic actuation device, different mixtures being able to be carried out easily by the appropriate controls of the actuation device of the valve systems and of the piston. Using the control unit of the machine, an operator can easily configure the travel of the piston and the controls for the opening and closing of the valve systems according to the desired mixture of the products.

According to an embodiment, the machine is of the rotating type, the machine comprising a central tank and a annular tank that are concentric, and a plurality of filling stations, the suction ducts of each filling station being connected to openings of the bottom walls of the concentric tanks.

Each filling station of the machine as such comprises its own actuation device for its piston and its valve systems. This particular configuration of the concentric tanks allows for a simple connection of the two tanks to the metering device by their bottom wall.

According to an embodiment, each valve system is formed of a clack valve mounted at the free end of the rod of a jack, more preferably pneumatic, the jacks constituting the second actuation device, in order to displace the clack valve between a sealing position and an opening position.

According to an embodiment, the cylinders of the clack valves mounted in the suction ducts are arranged vertically under the concentric tanks, the clack valves coming to seal, in their sealing position, upper openings through which the suction ducts are connected to the concentric tanks, and separating from the upper openings in their opening position.

According to an embodiment, the volumetric metering system comprises a plate, forming the lower portion of the cylinder, wherein are formed the suction ducts and the discharge duct, and whereon are mounted the jacks and the dispensing nozzle, the plate being assembled to the bottom walls of the concentric tanks in such a way that the vertical portions of the ducts come to connect to the openings of the bottom walls.

Advantageously, the suction ducts are connected to openings of the bottom walls of the concentric tanks by the intermediary of connecting ducts, in such a way that the suction ducts can have identical lengths, with their upper opening arranged substantially at an equal distance from the metering chamber.

BRIEF DESCRIPTION OF THE DRAWINGS

The invention shall be better understood, and other details, characteristics and advantages shall appear more clearly during the detailed explanatory description which shall follow of a particular currently preferred embodiment of the invention, in reference to the diagrammatical drawings, wherein.

DETAILED DESCRIPTION

Figure 2B:
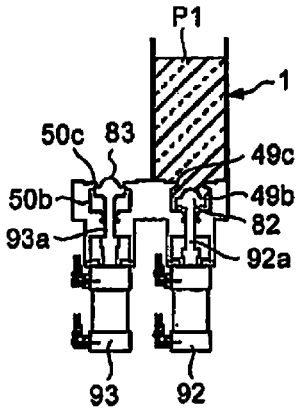
FIG. 2B depicts a diagrammatical view of the two clack valves of the suction ducts during the first suction phase in FIG. 2A.
Figure 2A:
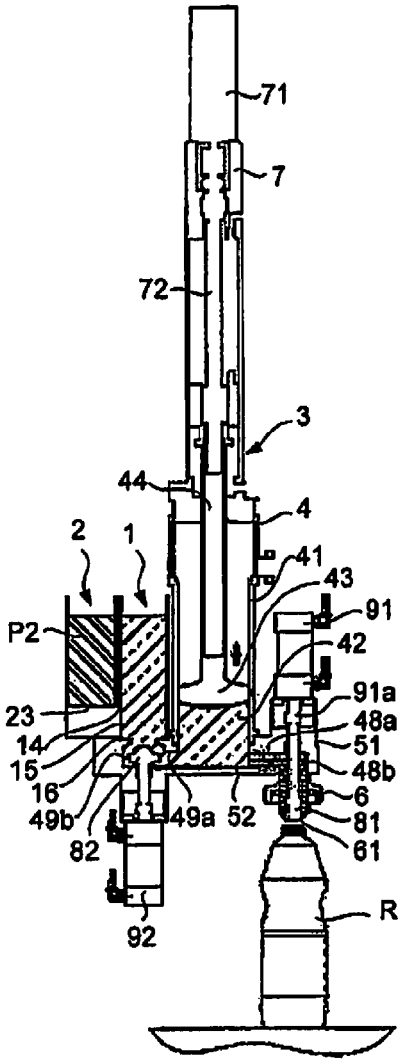
FIG. 2A depicts a diagrammatical view according to the cutting plane IIA-IIA in FIG. 1, showing a first suction phase of a product contained in the exterior annular tank.
Figure 1:
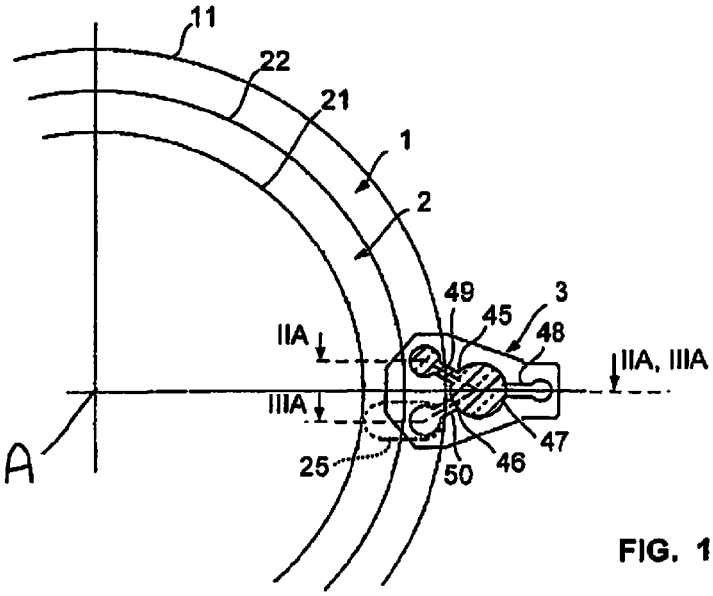
FIG. 1 depicts a diagrammatical partial top view of a machine according to the invention, depicting diagrammatically the positioning of a filling station.

In reference to FIGS. 1 and 2A, the machine is of the rotating type and comprises a rotating carrousel with vertical rotating axis A, carrying two concentric annular tanks 1, 2, partially shown in FIG. 2A, for the separate storage of two products P1 and P2, and a plurality of filling stations 3 arranged at regular angular spacing around the axis of rotation. The rotating carrousel (not shown) comprises conventionally a support structure mounted turning on a fixed frame around the vertical axis of rotation, the tanks being mounted on said structure support.

Figure 3A:
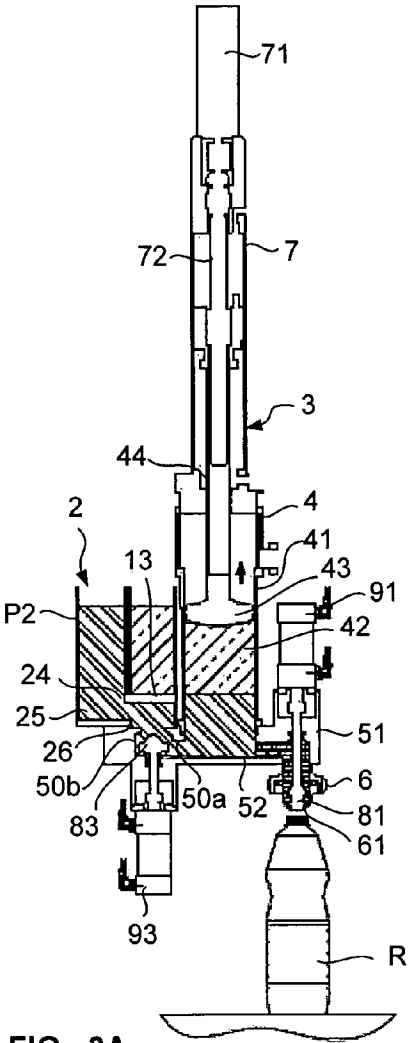
FIG. 3A is a view analogous to the FIG. 2A according to the cutting plane IIIA-IIIA, depicting a second suction phase of a product contained in the central annular tank.

The interior annular tank, referred to as central tank 2, is formed of a cylindrical interior lateral wall 21, a cylindrical intermediary lateral wall 22 and a planar bottom wall 23. The exterior annular tank, referred to as exterior tank 1, is formed by the intermediary lateral wall 22, a cylindrical exterior lateral wall 11 and a planar bottom wall 13 (FIG. 3A).

Each filling station 3 comprises a volumetric metering device 4 and a filling nozzle 6. The volumetric metering device comprises a cylinder 41 defining a substantially cylindrical metering chamber 42 wherein is mounted slidingly a suction and discharge piston 43. The cylinder is oriented substantially vertically and parallel to the lateral exterior wall 11. The piston is integral with an end of a hollow rod 44 which extends vertically upwards outside of the cylinder and which is connected to an actuation system 7 in order to displace the piston according to ascending suction movements and descending discharge movements. The actuation system 7 is formed by a motor 71, for example of the brushless or linear type, controlled by a parametrisable control unit (not shown) of the machine, the motor being able to drive in rotation, in both directions, a worm screw 72 whereon is mounted the hollow rod 44 of the piston.

According to FIG. 1, the cylinder has in the lower portion a first suction opening 45, a second suction opening 46 and a discharge opening 47. The discharge opening is connected by a discharge duct 48 to the filling nozzle. The first suction opening 45 is connected by a first suction duct 49 to an opening 14 arranged in the bottom wall 13 of the exterior tank. The second suction opening 46 is connected by a second suction duct 50 to an opening arranged 24 (FIG. 3A) in the bottom wall of the central tank.

In this embodiment, the metering device comprises a support plate 51, in one or several parties, in the general form of a plate, comprising on a first face, referred to as upper, a cylindrical recess 52. This plate is mounted on the cylinder and forms the lower portion of the latter, its recess coming according to the axis of the cylinder. The suction and discharge ducts are formed in this plate, each duct exiting on the lateral wall of the main recess.

The discharge duct 48 comprises a first horizontal portion 48*a* extending horizontally from the discharge opening 47 and being extended by a second vertical portion 48*b* which exits on the lower face of the plate, and to which the nozzle is connected. The filling nozzle 6 comprises a hollow body which is provided with a cylindrical internal passage oriented vertically, exiting on the lower face of the nozzle body in order to form a discharge opening 61. The nozzle body is mounted by its upper portion on the lower face of the plate, its internal passage in the axis of the second portion of the discharge duct.

In reference to FIGS. 2A and 3A, the suction ducts each include a first horizontal portion 49*a*, 50*a* extending from their respective suction opening 45, 46, and being extended by a second vertical portion 49*b*, 50*b* exiting on the upper face of the plate. The mounting of the metering device on the tanks is carried out by means of the plate, the plate being assembled on bottom walls of the tanks, in such a way that the vertical portions of the ducts come to connect to the openings 14, 24 of the bottom walls. According to FIG. 2A, the opening 14 of the exterior tank is provided with a first tubular connecting duct 15 extending vertically downwards and of which the lower opening 16 is connected to the first suction duct. According to the FIG. 3A, the opening 24 of the central tank is provided with a second tubular connecting duct 25 extending horizontally towards the exterior and having a lower opening 26 oriented downwards, and arranged substantially according to the horizontal plane of the opening of the first connecting duct 15 and at the same distance of the axis of the cylinder as the latter. When the plate is assembled on the tanks, the openings 49*c* and 50*c* of the suction ducts face respectively the openings 15 and 25 of the first and second connecting ducts.

As can be seen in FIG. 1, the suction ducts of identical length are arranged at the opposite of the discharge duct, symmetrically on either side of the horizontal axis of the discharge duct.

The nozzle is provided with a valve system making it possible to open and close the discharge opening 61. This valve system comprises a sealing clack valve 81 mounted in the filling nozzle and controlled for opening and for closing by a pneumatic jack 91. The body of the jack is mounted on the upper face of the plate, its rod 91*a* extends vertically in the vertical portion 48*b* of the discharge duct and in the axial passage of the nozzle and carries at its free end the clack valve 81, in such a way that the clack valve can be displaced vertically in translation by the jack between a low sealing position and a high opening position.

Each suction duct 49, 50 is provided with a valve system in order to open or close the opening 49*c*, 50*c* of its vertical portion 49*b*, 50*b*. Each valve system comprises a sealing clack valve 82, 83 mounted in the vertical portion and controlled for opening and for closing by a pneumatic jack 92, 93. The body of the jack is mounted vertically on the lower face of the plate, its rod 92*a*, 93*a* crosses the plate and extends vertically in the vertical portion of the suction duct and carries at its free end the clack valve 82, 83, in such a way that the clack valve can be displaced vertically in translation between a high sealing position, wherein the clack valve is bearing against an edge of the opening 49*c*, 50*c* and a low opening position wherein the clack valve is separated from said opening. The pneumatic jacks 91, 92, 93 are controlled by the control unit of the machine.

The operation of a filling station of the machine shall now be described with reference to the figures, in the case of a filling of a vessel R with a mixture of product P1 contained in the exterior tank and of product P2 contained in the central tank.

Figure 4A:
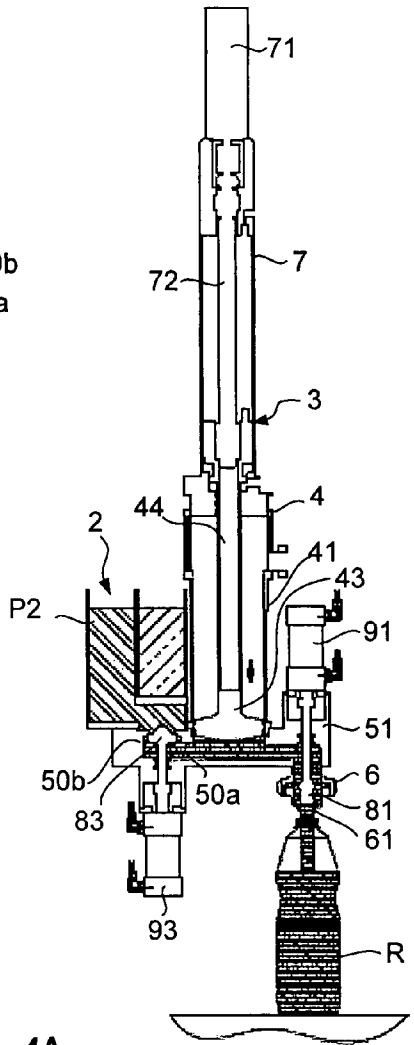
FIG. 4A is a view analogous to the FIG. 3A, depicting the discharge phase of the mixture of the two products in a vessel; and, FIG. 4B depicts a view of the two clack valves of the suction ducts during the discharge phase in FIG. 4A.
Figure 4B:
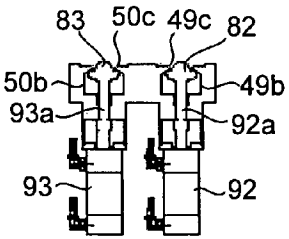
Figure 3B:
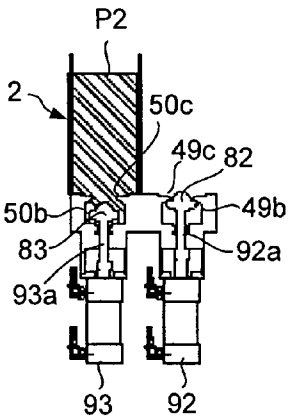
FIG. 3B depicts a view of the two clack valves of the suction ducts during the second suction phase in FIG. 3A.

In a first suction phase, the sealing clack valve 81 of the nozzle as well as the sealing clack valve 83 of the second suction duct being in sealing position such as in shown in FIGS. 2A and 2B, the clack valve 82 of the first suction duct is brought to the opening position by control of the jack 92, and the piston 43 is displaced upwards by control of the motor 71 in order to suck a determined quantity of product P1 into the metering chamber, from the exterior tank. Once the suction of the product P1 is complete, the clack valve of the first suction duct is displaced to the closing position, and the clack valve of the second suction duct is brought to the opening position in order to suck a determined quantity of product P2 from the central tank, such as is shown in FIGS. 3A and 3B. Once the suction is complete, the clack valve of the second suction duct is brought to the sealing position, the sealing clack valve of the nozzle is brought to the opening position by control of the jack 91, and the piston 43 is displaced downwards by control of the motor 71 in order to fill a vessel R placed under the discharge nozzle, such as is shown in FIGS. 4A and 4B. Starting with the position of the piston shown in FIG. 4A, a new filling cycle of a vessel can begin.

It is understood that as such, it is possible to easily vary the quantity of product P1 and of product P2 of each mixture by varying, via the parametrisable control unit, the travel of the piston 43 by appropriate control of the jacks and of the motor by the parametrisable control unit. Moreover, each filling station can be configured individually. The machine can in particular be used for filling vessels only with the product P1 and vessels only with the product P2.

Although the invention has been described in liaison with a particular embodiment, it is to be understood that the invention is not limited to a particular embodiment and comprises all of the technical equivalents of the means described as well as their combinations in so far as to fall within the scope of the invention. Various changes and modifications may be made by those of ordinary skill in the art without departing from the spirit and scope of the appended claims.

The invention claimed is:

1. A machine for filling vessels comprising at least two tanks for the storage of two filling products, and at least one filling station comprising a filling nozzle and a volumetric metering system, said volumetric metering system comprising a cylinder, provided with one suction and discharge piston driven by a first electric or pneumatic actuation device, and having a lower portion where is defined a metering chamber and providing with a first suction opening connected by a first suction duct to a first storage tank filled with a first filling product, with a second inlet suction opening connected by a second suction duct to the second tank filled with a second filling product, and with a discharge opening connected by a discharge duct to the filling nozzle; and valve systems able to be driven by second actuation device in order to selectively put the metering chamber in fluid communication with one or more of the first tank, the second tank and the filling nozzle, said valve systems including a first valve system and a second valve system mounted respectively in the first suction duct and the second suction duct, and a third valve system arranged on the filling nozzle, each valve system being driven individually for opening and for closing by second individual pneumatic or electrical actuation device connected to a parametrisable control unit of the machine, each valve system being formed of a clack valve mounted at the free end of a rod of a jack in order to displace said clack valve between a sealing position and an opening position, said suction and discharge piston being driven individually from each valve system by the first actuation device connected to said control unit and being displaced downward in the metering chamber in order to fill a vessel placed under the filling nozzle with a first quantity of the first filling product and with a second quantity of the second filling product, the volumetric metering system comprises a plate, forming the lower portion of the cylinder, the suction ducts and the discharge duct being formed in the plate, the plate being mounted on the cylinder and forms the lower portion of the cylinder with a recess coming according to the axis of the cylinder, the suction ducts and the discharge duct exiting on the lateral wall of the recess, and on which are mounted the jacks and the dispensing nozzle, said plate being assembled at the bottom walls of the concentric tanks in such a way that some vertical portions of the ducts come to connect to the openings of the bottom walls.

2. A machine according to claim 1 wherein the machine is of the rotating type, said machine comprising a central interior tank and a annular exterior tank that are concentric, and a plurality of filling stations, said suction ducts of each filling station being connected to an opening of the bottom walls of said concentric tanks.

3. A machine according to claim 1, wherein the jacks of clack valves mounted in the suction ducts are arranged vertically under the concentric tanks, said clack valves coming to seal in their sealing position some upper openings through which the suction ducts are connected to the concentric tanks, and separating from said upper openings in their opening position.

4. A machine according to claim 3, wherein the suction ducts are connected to openings of the bottom walls of the concentric tanks by some connecting ducts.

5. A machine according to claim 4, wherein the suction ducts have identical lengths, their upper openings being arranged substantially at an equal distance from the metering chamber.

6. A machine according to claim 4, wherein the plate being assembled on bottom walls of the tanks, in such a way that some vertical portions of the suction ducts come to connect to the openings of the bottom walls, the opening of the exterior tank is provided with a first tubular connecting duct extending vertically downwards and of which a lower opening is connected to the first suction duct, the opening of the central interior tank is provided with a second tubular connecting duct extending horizontally towards the exterior and having a lower opening oriented downwards, and arranged substantially according to the horizontal plane of the opening of the first connecting duct, the openings of the suction ducts face respectively the openings of the first and second connecting ducts.

* * * * *